US006939171B2

(12) United States Patent
Fukatsu et al.

(10) Patent No.: US 6,939,171 B2
(45) Date of Patent: Sep. 6, 2005

(54) CONNECTOR, MOLDING METHOD THEREFOR AND MOLDING APPARATUS THEREFOR

(75) Inventors: Yukihiro Fukatsu, Yokkaichi (JP); Toshikazu Sakurai, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/809,010

(22) Filed: Mar. 25, 2004

(65) Prior Publication Data

US 2004/0192109 A1 Sep. 30, 2004

(30) Foreign Application Priority Data

Mar. 26, 2003 (JP) ..... 2003-084890

(51) Int. Cl.[7] ..... H01R 13/40
(52) U.S. Cl. ..... 439/595; 439/752
(58) Field of Search ..... 439/595, 752

(56) References Cited

U.S. PATENT DOCUMENTS 5,235,743 A 8/1993 Endo et al.
6,244,900 B1 * 6/2001 Ishikawa et al. ..... 439/595
6,338,654 B1 * 1/2002 Sasaki et al. ..... 439/595
6,626,701 B2 * 9/2003 Yoshida et al. ..... 439/595

* cited by examiner

*Primary Examiner*—Truc Nguyen
(74) *Attorney, Agent, or Firm*—Gerald E. Hespos; Anthony J. Casella

(57) ABSTRACT

A connector has a housing (10) with a cavity (11) and a resiliently deformable lock (13) for locking a female terminal fitting (30) in the cavity (11). The lock (13) has a base (25) and a projection (26) that projects into the cavity (11) from the base (25). Both side surfaces (25*b*) of the base (25) are formed by a mold that is moved forward to open, and notches (17*a*) are formed in the front surface of the female housing (10) by this mold. The notches (17*a*) extend more outward than inner side surfaces (11*b*) of the cavity (11) with respect to the widthwise direction. Both side surfaces (26*c*) of the projection (26) are formed by a mold moved backward to open. The projection (26) is narrower than the base (25).

10 Claims, 15 Drawing Sheets

CONNECTOR, MOLDING METHOD THEREFOR AND MOLDING APPARATUS THEREFOR

BACKGROUND OF THE INVENTION

1. Field of the Invention

The invention relates to a connector and to a method for molding a connector housing.

2. Description of the Related Art

U.S. Pat. No. 5,235,743 discloses a connector that has a housing formed with cavities and resilient locks that project from inner surfaces of the cavities. Terminal fittings are insertable into the cavities of the housing and are locked by the resilient locks to prevent the terminal fittings from coming out of the cavities.

A recent demand to miniaturize connectors has led to smaller cavities, smaller locks and smaller terminal fittings. Thus, forces for locking the terminal fittings may be insufficient.

The present invention was developed in view of the above problem and an object thereof is to allow a connector to be suitably miniaturized.

SUMMARY OF THE INVENTION

The invention relates to a connector with a housing. At least one cavity is formed in the housing and a resiliently deformable lock is provided in each cavity. A terminal fitting is insertable into the cavity and deforms the lock. The lock then returns resiliently to engage the terminal fitting. The lock has a base and a projection that projects at least partly into the cavity from the base. The base has opposite widthwise side surfaces molded by a mold that is moved forward to open. A notch is molded by the mold and opens in the front surface of the housing. However, the notch extends farther out than the inner side surface of the cavity with respect to the widthwise direction. The projection has opposite widthwise side surfaces molded by a mold moved back to open and is narrower than the base.

The width of the base preferably is larger by the width of the notch. As a result, the strength of the base and a locking force for the terminal fitting are increased. The notch is only in an area of the housing before the base of the lock, and has only a small length area as compared to the entire housing. Thus, the notch does not significantly reduce the strength of the housing.

If the projection had the same width as the base, then a rearwardly open notch would be formed in the inner surface of the cavity by a mold that is moved backward to open. The length of this rearwardly open notch would be larger than the forward-opening notch, and the strength of the housing could be reduced. Accordingly, the projection is narrower than the base in the present invention. Therefore, it is not necessary to form the backward-opening notch or even if such an opening is formed, it can have a smaller width than the forward-opening notch. As a result, the housing is strong.

A maneuverable portion that is maneuverable by a jig to resiliently deform the lock in the unlocking direction is provided at the front surface of the base of the lock. The maneuverable portion preferably is formed in a width range to cover a part of the base that bulges out more than the projection with respect to the widthwise direction.

The maneuverable portion is wide and thus a section of the maneuverable portion into which the jig is insertable can be wider. Thus, the operability of the lock by the jig is improved and the strength of the jig is enhanced.

Reinforcements preferably are between the projection and the base.

The invention also relates to a method for molding a connector, such as the above-described connector. The connector has a housing with at least one cavity into which a terminal fitting is insertable along an inserting direction. A resiliently deformable lock is provided in the cavity for engaging the terminal fitting. The lock has a base and a projection projects into the cavity from the base. The method comprises molding opposite widthwise side surfaces of the base by a mold that is moved forward to open and molding a notch that is open in the front surface of the housing by this mold and extending more outward than the inner side surface of the cavity with respect to widthwise direction. The method also includes molding the opposite widthwise side surfaces of the projection by a mold that is moved backward to open so that the projection is narrower than the base.

The lock preferably is molded to have a maneuverable portion at the front surface of the base. Thus, the lock can be maneuvered by a jig to resiliently deform the lock in unlocking direction.

The maneuverable portion preferably has a width to cover a part of the base bulging out more than the projection with respect to the width.

Reinforcements preferably are provided between the projection and the base.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A female connector according to a preferred embodiment of the invention is described with reference to FIGS. 1 to 15.

The female connector includes a female housing 10 into which female terminal fittings 30 are inserted. Each female terminal fitting 30 is electrically connectable with a male terminal fitting (not shown) accommodated in a male housing (not shown) that is fit into the female housing 10. In the following description, an inserting direction ID of the female terminal fitting 30 into the female housing 10 is referred to as a forward direction, a withdrawing direction of the female terminal fitting 30 from the female housing 10 is referred to as a backward direction, and reference is made to all the drawings except FIGS. 5 and 10 concerning vertical direction.

Figure 5:
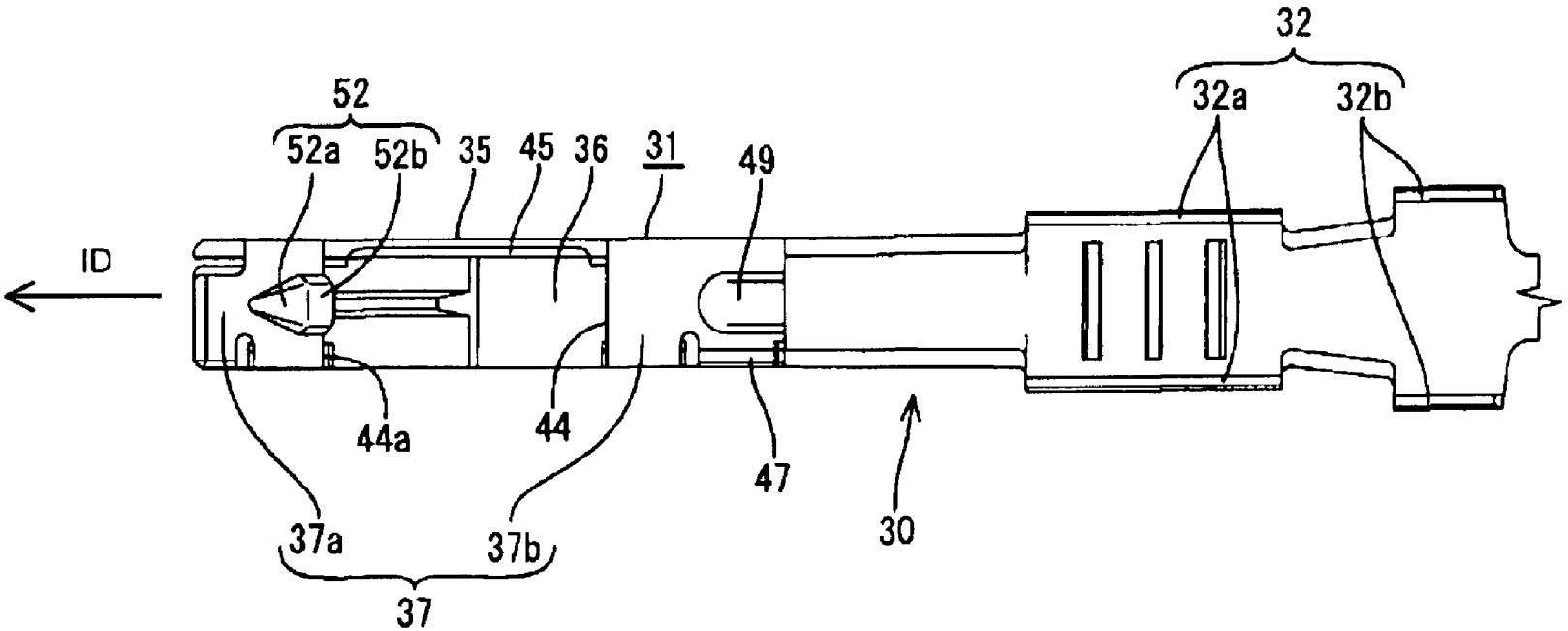
FIG. 5 is a bottom view of the female terminal fitting.
Figure 6:
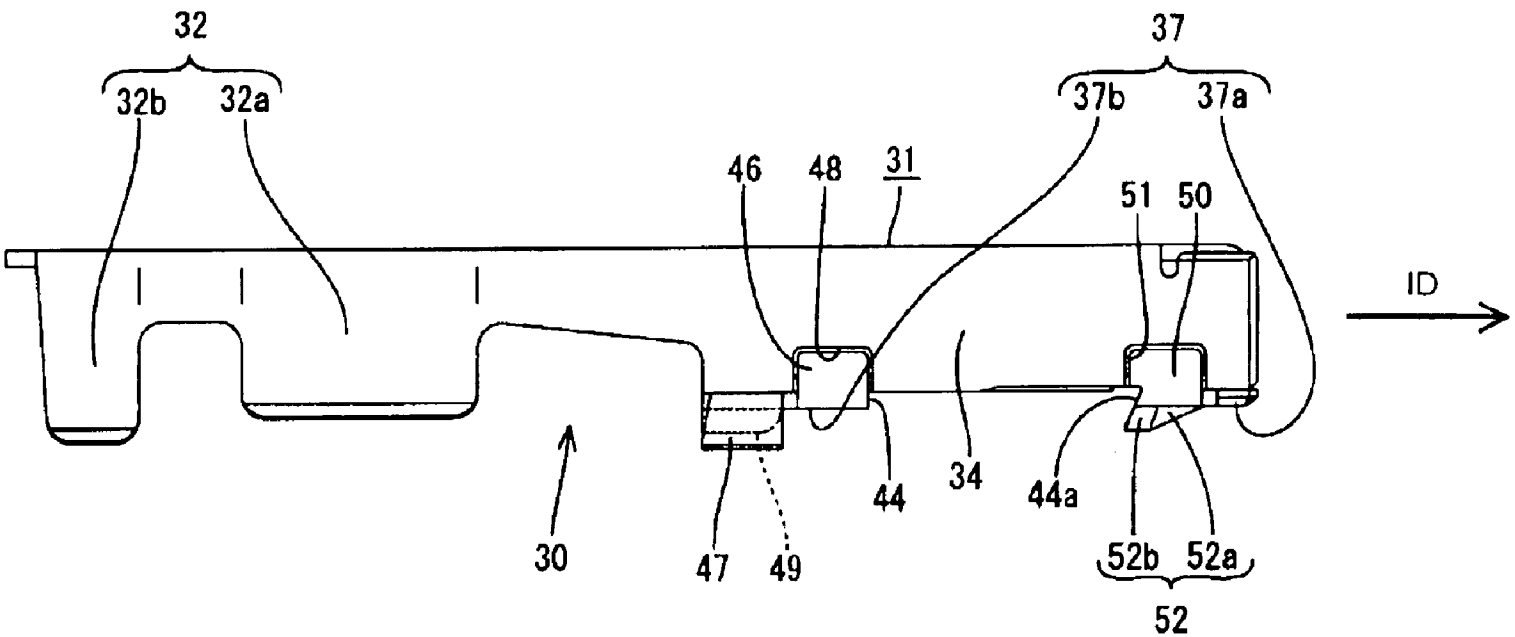
FIG. 6 is a left side view of the female terminal fitting.
Figure 7:
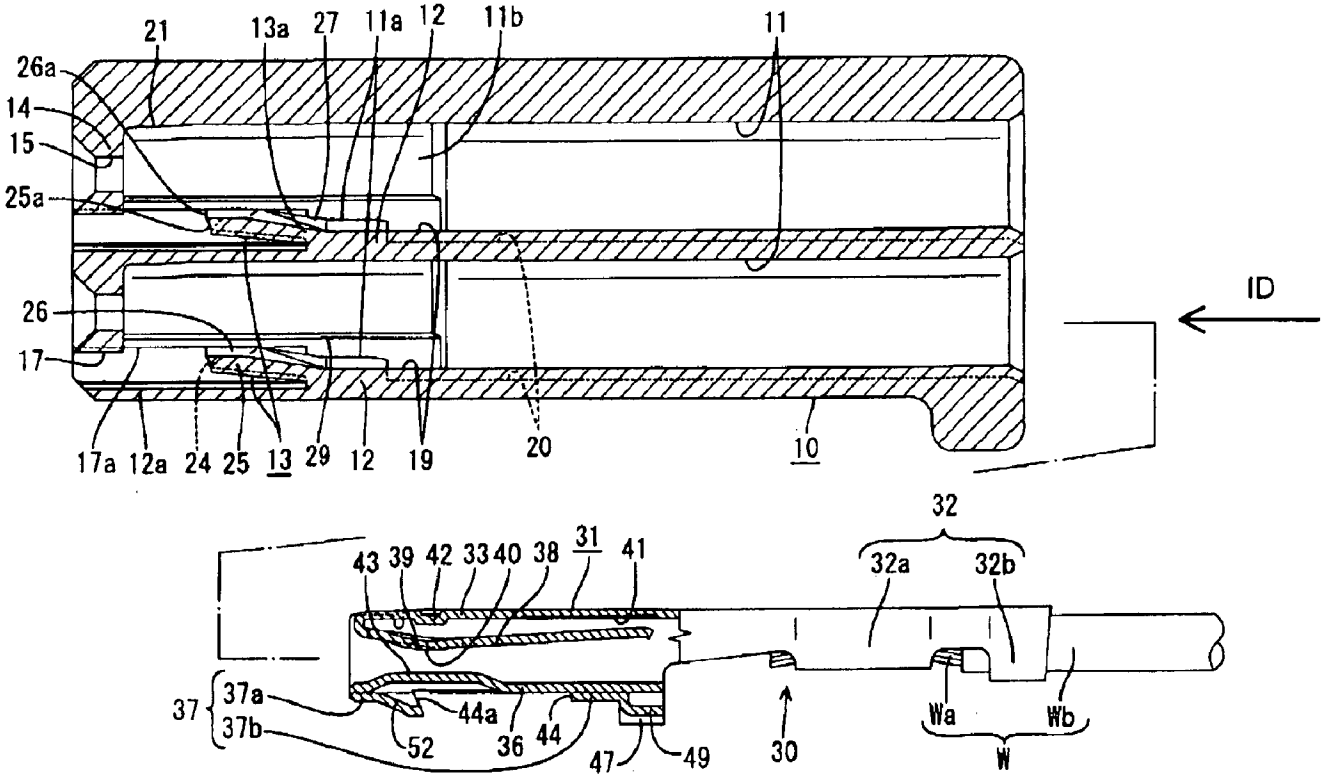
FIG. 7 is a side view in section showing a state where the female terminal fitting is inserted into the female housing.

Each female terminal fitting 30 is formed into a desired shape by embossing, folding and/or bending a conductive metal piece of a specified shape stamped or cut out from a conductive metallic base material. As shown in FIGS. 5, 6 and 7, the female terminal fitting 30 has a substantially box-shaped main body 31 that is hollow along forward and backward directions, and hence along the inserting direction ID. A barrel 32 is arranged behind the main body 31. The barrel 32 includes two front crimping pieces 32*a* that can be crimped into connection with a core Wa of a wire W and two rear crimping pieces 32*b* that can be crimped into connection with an insulation coating Wb of the wire W.

The main portion 31 has a bottom wall 33 that extends along forward and backward directions. Two sidewalls 34, 35 stand up from opposite lateral edges of the bottom wall 33. A ceiling wall 36 projects from the projecting end of the left sidewall 34 of FIG. 4 to face the bottom wall 33. An outer wall 37 projects from the projecting end of the right sidewall 35 of FIG. 4 and is placed at least partly on the outer side of the ceiling wall 36.

The front end of the bottom wall 33 is retracted back as compared with the front ends of the other walls 34, 35, 36, 37, as shown in FIG. 7. A resilient contact piece 38 is cantilevered from the front end of the bottom wall 33 and is folded back to face the bottom wall 33 and the ceiling wall 36 at an angle of between about 5° and about 45° to the inserting direction. The resilient contact piece 38 has a forward inclined portion and a backward inclined portion that are arranged successively behind a substantially U-shaped fold. An area extending from the forward inclined portion to the backward inclined portion is embossed to define a bulge 39 that projects toward the ceiling wall 36. The bulge 39 has a substantially oblong shape that is narrow along the inserting direction ID. A top of the bulge 39 defines a contact 40 that can be brought into contact with a tab of the mating male terminal fitting. The tab of the male terminal fitting presses the contact 40 and deforms the resilient contact piece 38 towards the bottom wall 33 with the fold as a supporting point of resilient deformation. The rear end of the resilient contact piece 38 can be brought into contact with the inner surface of the bottom wall 33 during the resilient deformation. A part of the inner surface of the bottom wall 33 is formed with a recess 41 over a specified length to permit the resilient contact piece 38 to be deformed to a larger extent and/or to guide the contact piece 38 or to prevent widthwise displacement of the deformed resilient contact piece 38 along the widthwise direction WD. The widthwise direction WD is substantially normal to the inserting direction ID.

The bottom wall 33 is embossed at least at a position substantially facing the contact 40 to project toward the contact 40, and to form an excessive deformation-restricting portion 42. The resilient contact piece 38 is engageable with the excessive deformation-restricting portion 42, thereby preventing deformation beyond the resiliency limit of the contact piece 38. A receiving portion 43 is provided on the ceiling wall 36 and bulges towards the resilient contact piece 38 at a position on the ceiling wall 36 facing the bulge 39. The tab of the male terminal fitting can be squeezed between the receiving portion 43 and the resilient contact piece 38.

A cut-away portion 44 extends over the entire width of the outer wall 37 at an intermediate portion and divides the outer wall 37 into a front part 37*a* and a rear part 37*b*, as shown in FIGS. 5 and 7. The cut-away portion 44 has a front cut end surface 44*a* that is inclined in and up to the front over the entire width to define an overhang or undercut. The cut-away portion 44 has a length slightly less than half the length of the outer wall 37 and extends to the front end of the sidewall 35 at the upper side of FIG. 5. A bulge 45 projects from the projecting end of the ceiling wall 36 and contacts the adjacent upper end surface of the side wall 35, which is the cut end surface at the side of the cut-away portion 44. As a result, the ceiling wall 36 is supported in a substantially normal or horizontal posture. A front portion of the ceiling wall 36 is recessed near the receiving portion 43 to be slightly lower than a rear portion over substantially the entire area excluding a contact portion of the bulge 45 with the sidewall 35. A dimension of the front part 37*a* of the outer wall 37 along the insertion direction ID is slightly shorter than that of the rear part 37*b*.

A rear holding piece 46 and a stabilizer 47 are provided one after the other at the projecting end of the rear part 37*b* of the outer wall 37. The rear holding piece 46 is bent towards the bottom wall 33 and substantially onto the sidewall 34, as shown in FIGS. 5 and 6. The rear holding piece 46 is fit into a rear-holding groove 48 in the sidewall 34, as shown in FIG. 6. As a result, the rear part 37*b* is held so as not to move loosely forward and backward. The stabilizer 47 is bent towards the opposite side and is inserted into a stabilizer insertion groove 20 in the cavity 11 to guide the insertion of the female terminal fitting 30. The front end of the rear holding piece 46 substantially aligns with the front end of the rear part 37*b*, and the rear end of the stabilizer 47 substantially aligns with the rear end of the rear part 37*b*. A protrusion 49 is embossed or cut and bent to project out at an intermediate portion of the rear end of the rear part 37*b* and has substantially the same length as the stabilizer 47. The protrusion 49 can contact the bottom surface of the cavity 11 when the female terminal fitting 30 is inserted into the cavity 11.

A front holding piece 50 is provided at the projecting end of the front part 37*a* of the outer wall 37 and is bent toward the bottom wall 33. The front holding piece 50 is fit into a front holding groove 51 in the sidewall 34, as shown in FIG. 6. Thus, the front part 37*a* of the outer wall 37 is held so as not to move loosely forward and backward. The rear end of the front holding piece 50 is more backward than the front part 37*a* of the outer wall 37. The cut-away portion 44 is extended to the base end of the front holding piece 50, and the cut end surface 44*a* of the cut-away portion 44 at this extended section is formed as an overhanging or undercut surface, as described above.

A locking projection 52 is embossed to project down and out at the front part 37*a* of the outer wall 37 at a position slightly displaced laterally from the widthwise middle. As shown in FIGS. 5 and 7, the locking projection 52 includes a pyramidal portion 52*a* and a rectangular tube portion 52*b*. The pyramidal portion 52*a* is formed by three slanted surfaces that converge towards the front with a vertex at the front end. Thus, the width and height of the pyramidal portion 52*a* decrease towards the front end, and the front end of the pyramidal portion 52*a* is tapered and slightly rounded.

The rectangular tube portion 52*b* has a substantially constant width and height and is comprised of three side surfaces. The rectangular tube portion 52*b* overhangs backward substantially along the inclination of the front cut end surface 44*a* of the cut-away portion 44, and the rear end of the rectangular tube portion 52*b* is more backward than the front part 37*a* of the outer wall 37. The rectangular tube portion 52*b* is substantially trapezoidal when viewed from behind.

This locking projection 52 projects up to substantially the same height as the protrusion 49. The rear end surface of the locking projection 52 is formed by the front cut end surface 44*a* of the cut-away portion 44 and defines a locking surface that is overhanging or undercut. Sections of the rear end surface of the front part 37*a* of the outer wall 37 at the opposite sides of the locking projection 52 also are formed by the overhanging or undercut front cut end surface 44*a* of the cut-away portion 44.

Figure 1:
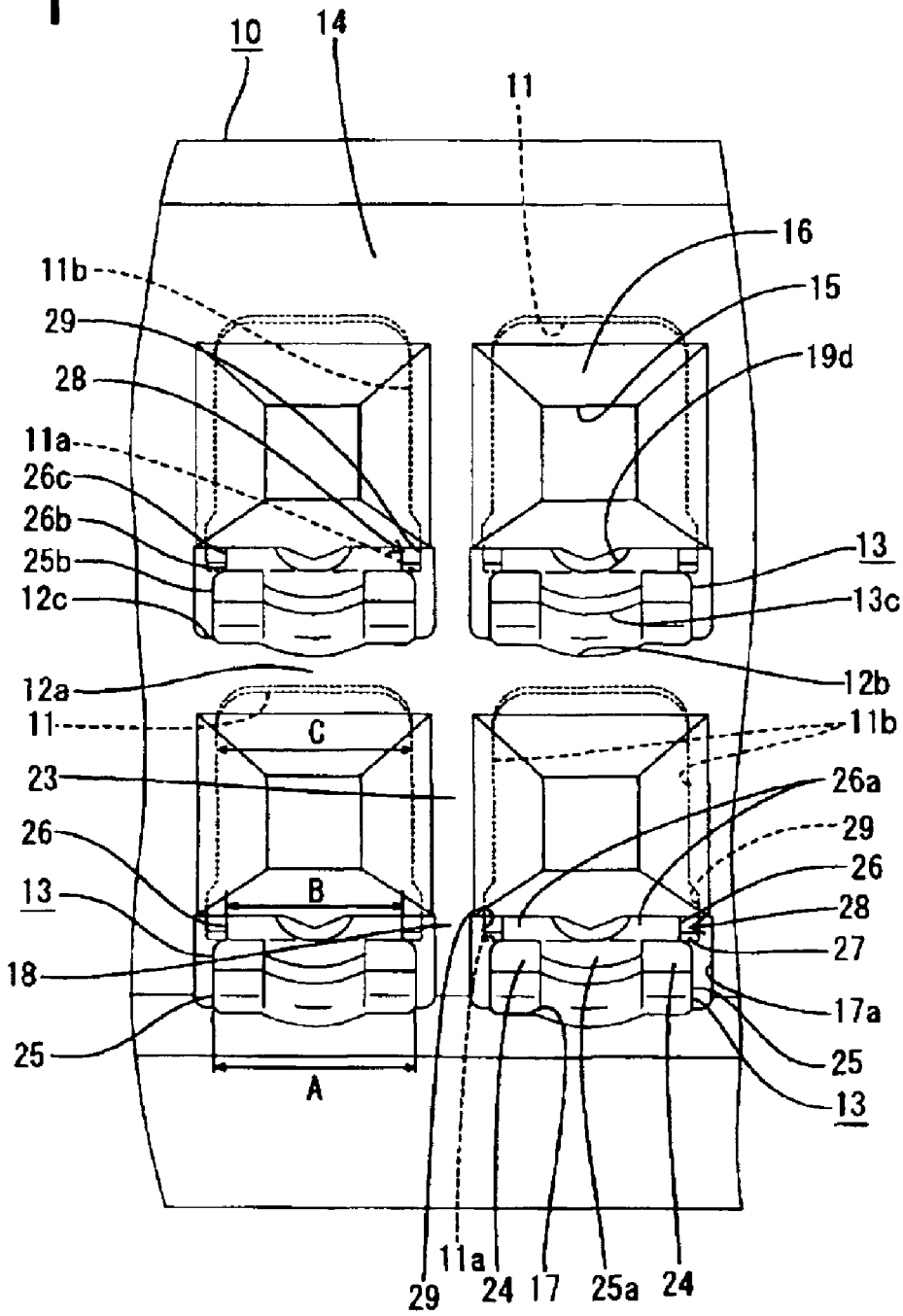
FIG. 1 is a front view of a female housing according to one embodiment of the invention.

The female housing 10 is molded of resin using first and second molds that can be opened and closed substantially along forward and backward directions parallel to the inserting direction ID of the female terminal fittings 30. Cavities 11 are arranged along the widthwise direction WD at upper and lower stages in the female housing 10, as shown in FIGS. 1 and 7. The female terminal fittings 30 can be inserted respectively into the cavities 11 from behind and along the inserting direction ID. The cavities 11 each have a bottom wall 12 and locks 13 project forward from the bottom wall 12 of the respective cavities 11. The female housing 10 also has a front wall 14 that defines a front limit position for the forward movement of the female terminal fittings 30 into the respective cavities 11. The front wall 14 of the female housing 10 has tab insertion holes 15 for permitting insertion of the tabs of the mating male terminal fittings into the cavities 11 from the front. Tapered guiding surfaces 16 are formed over substantially the entire periphery at the front edges of the tab insertion holes 15 for smoothly guiding the insertion of the tabs.

Less than about half, and most preferably about a quarter of the front side is lowered slightly to define a step and the cantilever-shaped lock 13 projects forward from the stepped portion. The lock 13 is inclined in and up to the front towards the inside of the cavity 11. A part of the lock 13 that projects into the cavity 11 is pressed as the female terminal fitting 30 is inserted. Thus, the lock 13 is deformed resiliently out and down about a deformation base end 13*a* in a direction that intersects the inserting and withdrawing directions of the female terminal fitting 30. During this resilient deformation, the lock 13 retracts into a deformation space defined between the lock 13 and a recess 12*a* of the bottom wall 12. The locking projection 52 of the female terminal fitting 30 can enter the space before the lock 13. The lowered part 12*a* of the bottom wall 12 facing the lock 13 from below prevents the lock 13 from being deformed excessively by engaging the lower or outer surface of the lock 13 before the lock 13 is deformed beyond its resiliency limit. The lock 13 is covered and protected by the recess 12*a* of the bottom wall 12 coupled to the front wall 14 without being exposed to the cavity 11 below or to the outside.

Figure 2:
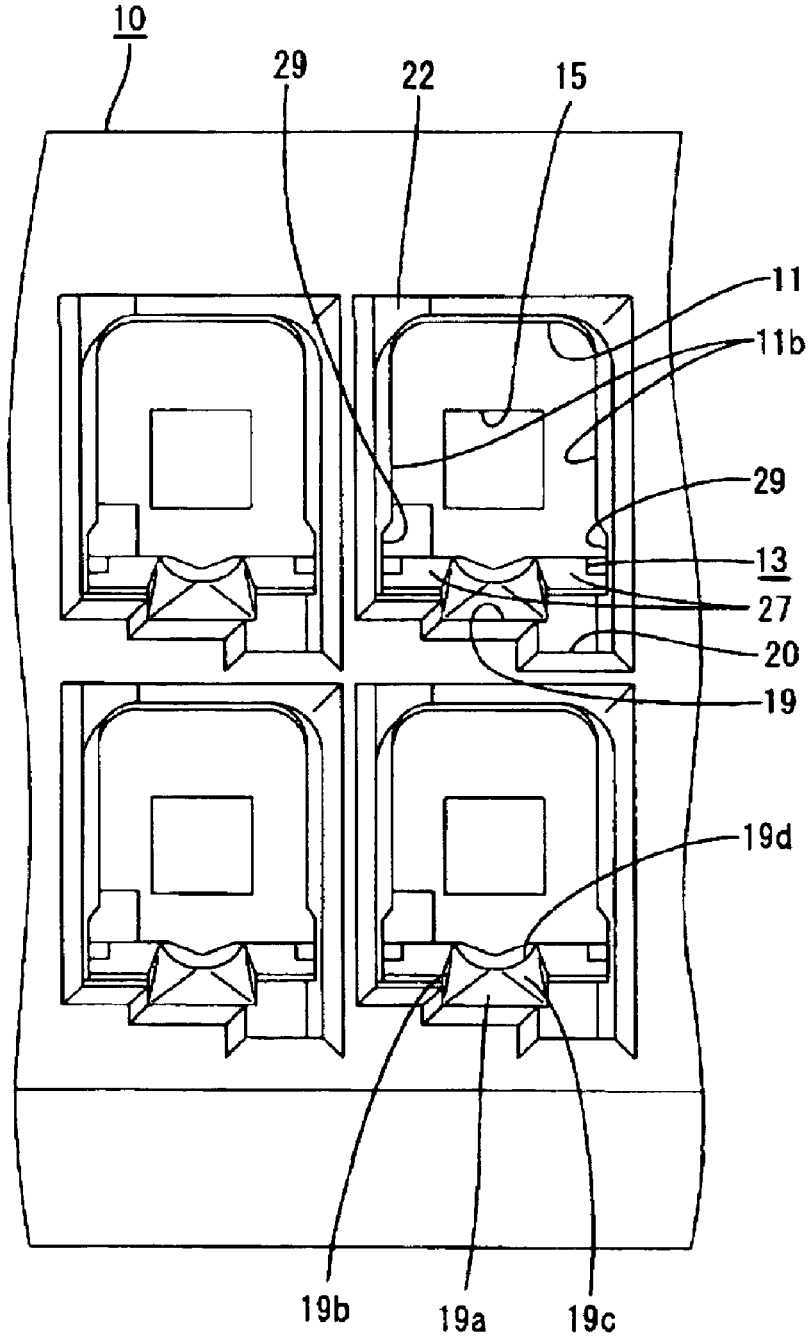
FIG. 2 is a rear view of the female housing.

Grooves are formed in the bottom surface 11*a* of each cavity 11 and, as shown in FIGS. 2 and 7, conform to the shape of the female terminal fitting 30. Specifically, a protrusion insertion groove 19 is formed at a widthwise middle position of the cavity 11 for receiving the locking projection 52 and the protrusion 49 of the female terminal fitting 30. A stabilizer insertion groove 20 is lower than the protrusion insertion groove 19 and is formed to the right of the protrusion insertion groove 19, as shown in FIG. 2, for receiving the stabilizer 47 of the female terminal fitting 30. The protrusion insertion groove 19 is formed continuously in the lock 13. However, the front end of the stabilizer insertion groove 20 is slightly behind the lock 13.

The height of the cavity 11 slightly exceeds the height of the main portion 31 except its front end. Hence, the cavity 11 defines a clearance to the main portion 31. A bulge 21 is formed on the upper surface of the front end of the cavity 11 and bulges towards the lock 13 over substantially the entire width. Thus, the height of the front of the cavity 11 substantially equals the height of the main portion 31. Further, inner side surfaces 11*b* gradually bulge out at intermediate positions so that a front half of the cavity 11 for accommodating the main portion 31 is narrower than a rear portion for accommodating parts of the female terminal fitting 31 behind the main portion 31.

The rear peripheral edge of the cavity 11 is slanted over substantially the entire periphery to guide the female terminal fitting 30. A restricting portion 22 is at a lateral corner position (upper-left) of the rear peripheral edge of the cavity 11 in FIG. 2 and forms an end surface substantially normal to the inserting direction ID and withdrawing direction of the female terminal fitting 30. The stabilizer 47 abuts the restricting portion 22 to prevent an improper, e.g. upside-down, insertion of the female terminal fitting 30.

Figure 3:
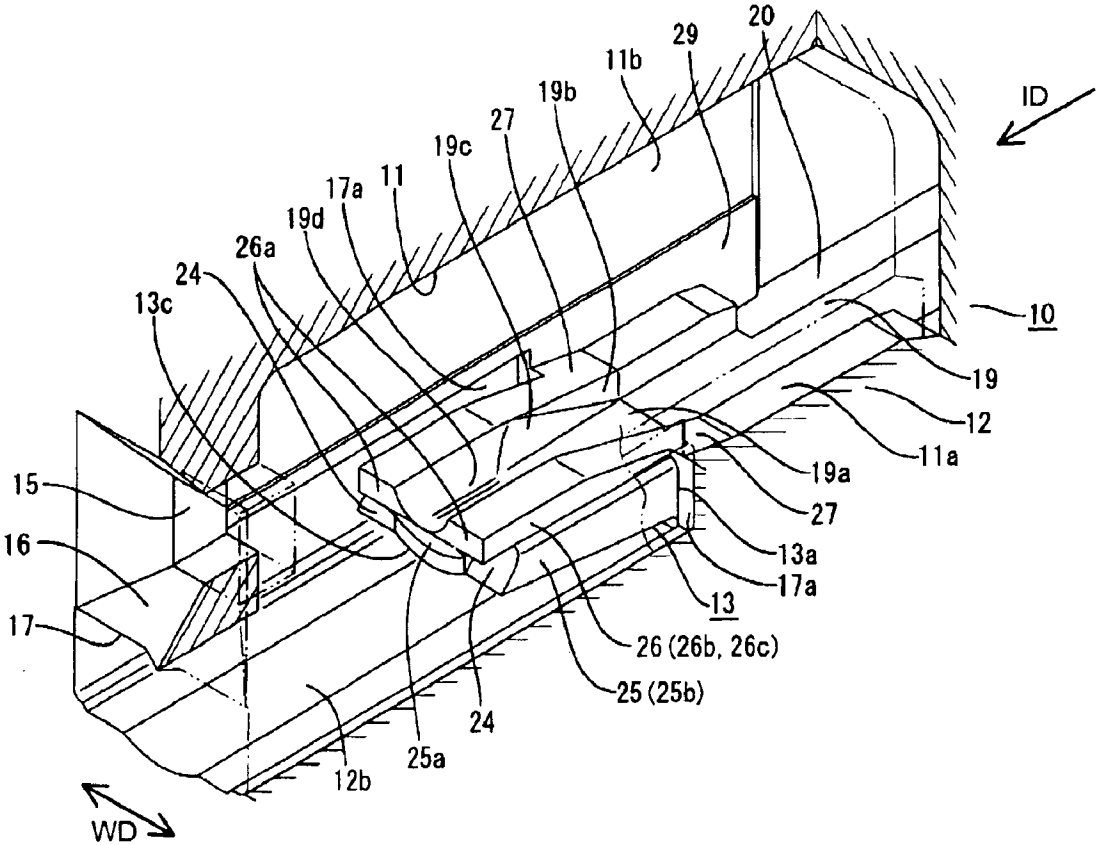
FIG. 3 is a partial perspective view partly in section showing the female housing.
Figure 4:
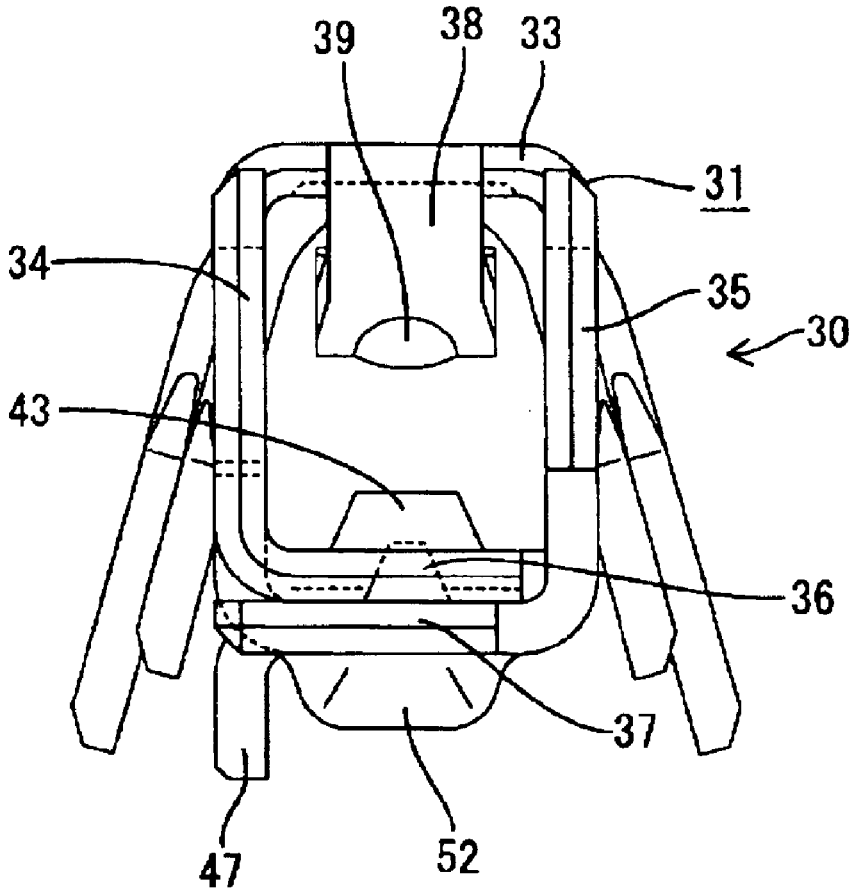
FIG. 4 is a front view of a female terminal fitting.

As shown in FIG. 3, the lock 13 has a base 25 that is cantilevered forward from the front end of the bottom wall 12 and a projection 26 projects into the cavity 11 from the upper surface of the base 25. The base 25 has a deformation base end 13*a* that serves as the support during deformation. The inner surface of the base 25 is substantially horizontal along forward and backward directions and hence is substantially parallel to the inserting direction ID. However, the lower surface of the base 25 is sloped moderately in and up towards the front. Thus, the thickness of the base 25 gradually increases towards the back. A rear part of the upper surface of the projection 26 is sloped in towards the back and a front part of the upper surface of the projection 26 is substantially horizontal along forward and backward directions and hence is substantially parallel to the inserting direction ID. Accordingly, a rear part of the projection 26 has a thickness that gradually increases towards the front and a front part of the projection 26 has a substantially constant thickness.

The upper surface of the lock 13 is recessed substantially at its widthwise center and along substantially the entire length by the protrusion insertion groove 19. The width of the protrusion insertion groove 19 at the rear part of the lock 13 gradually decreases towards the front. Additionally, the protrusion insertion groove 19 has a bottom surface 19*a*, two substantially vertical side surfaces 19*b* and two inwardly-slanted surfaces 19*c* that couple the opposite side surfaces 19*b* and the bottom surface 19*a*. The protrusion insertion groove 19 at the front part of the lock 13 has a substantially constant width over substantially the entire length, and has an arcuate surface 19*d*. The projection 26 is divided into left and right sections over the entire length by the protrusion insertion groove 19, whereas the base 25 has its rear part obliquely cut by the protrusion insertion groove 19 to have a specified depth.

A lower part at a substantially middle of the front surface of the base 25 extends vertically substantially normally to the inserting direction ID. However, a projection locking surface 25*a* slants up and towards the front at an upper part of the front surface of the base 25 for engaging the locking projection 52 of the female terminal fitting 30. Two forwardly open maneuverable recesses 24 recede back at opposite widthwise ends of the front surface of the base 25 at positions adjacent the projection locking surface 25*a* with respect to widthwise direction WD. The maneuverable recesses 24 are maneuverable by a disengagement jig 60 to forcibly deform the lock 13. Both maneuverable recesses 24 are exposed to the outside at the front and in positions displaced from the locking projection 52 along widthwise direction WD even when the female terminal fitting 30 is engaged with the lock 13. Thus, the maneuverable recesses 24 can be pressed in an unlocking direction by the disengagement jig 60 inserted into the maneuverable recesses 24 from the front. Each maneuverable recess 24 is defines a substantially triangle cut in the lock 13 when viewed sideways. The upper surface of the maneuverable recesses 24 is substantially horizontal, whereas the bottom surface is sloped up and in towards the back. An arcuate surface 13*b* is formed at a substantially widthwise middle of the lower surface of the base 25 over substantially the entire length of the base 25 and is curved more moderately than the arcuate surface 19*d* of the protrusion insertion groove 19. A similar arcuate surface 12*b* is formed in the lowered part 12*a* of the bottom wall 12. Slightly raised jutted portions 12*c* are formed at the opposite sides of the arcuate surface 12*b* of the lowered part 12*a* of the bottom wall 12, as shown in FIG. 1.

A main-portion locking surface 26*a* extends substantially normal to the inserting direction ID at the front of the projecting portion 26. Additionally, the main-portion locking surface 26*a* is substantially continuous with the upper end of the projection locking surface 25*a* of the base 25. The main-portion locking surface 26*a* engages the front cut end surface of the cut-away portion 44 at opposite sides of the locking projection 52. Two reinforcements 27 couple the rear of the projection 26 with the upper surface of the bottom wall 25, and are disposed so that the protrusion insertion groove 19 at the front end of the bottom surface 11*a* of the cavity 11 is between the reinforcements 27. The reinforcements 27 increase the strength of the entire lock 13. The reinforcements 27 also are coupled to the inner side surfaces 11*b* of the cavity 11, and the upper surfaces of the reinforcements are slanted and substantially continuous with the rear part of the upper surface of the projection 26. The reinforcements 27 bulge out from the bottom surface 11*a* of the cavity 11. However, the reinforcements 27 do not hinder insertion and withdrawal of the female terminal fitting 30 since the height of the reinforcements 27 is substantially equal to or shorter than the clearance between the main portion 31 and the cavity 11.

As shown in FIGS. 1 and 3, the base 25 of the lock 13 is wider than the projection 26. Width A of the base 25 is larger than width C of the cavity 11, whereas width B of the projection 26 is slightly less than the width C of the cavity 11. Accordingly, the maneuverable recesses 24 at opposite sides of the front surface of the base 25 bulge out more than the projection 26 with respect to the widthwise direction. Both upper corners of the base 25 are rounded.

The locks 13 are formed by two molds that open and close along forward and backward directions. More specifically, the front surfaces of the locks 13, side surfaces 25*b* of the bases 25, the front surfaces of the reinforcements 27 and side surfaces 26*b* of the projections 26 overlapping the reinforcing portions 27 with respect to the height direction are formed by the mold that is moved forward to open. On the other hand, the upper and rear surfaces of the projections 26, the rear surfaces of the reinforcements 27, the inner side surfaces 11*b* of the cavities 11 and side surfaces 16*c* of the projections 26 displaced from the reinforcements 27 with respect to the height direction are formed by the mold that is moved back to open. Spaces 28 between the opposite side surfaces 26*c* of the projections 26 displaced from the reinforcements 27 with respect to the height direction (i.e. a direction normal to the inserting direction ID and the widthwise direction WD) and the inner side surfaces 11*b* of the cavities 11 are open forward and backward. Thus, the opposite side surfaces 26*c* and the inner side surfaces 11*b* of the cavities 11 are formed by the same mold moved backward to open. Accordingly, the front and rear molds are prevented from abutting in the spaces 28 when sliding the rear mold in contact with the front mold.

Mold removal holes 17 are open forward at positions below the tab insertion holes 15 in the front surface of the female housing 10 and are formed by the mold that is moved forward to open. The mold removal holes 17 form accommodating spaces for the locks 13, and the accommodating spaces for the locks 13 adjacent to each other along the widthwise direction WD are partitioned by walls 18 that are substantially continuous with side walls 23 that partition the cavities 11 that are adjacent to one another along the widthwise direction WD. Notches 17*a* are formed at portions of each mold removal hole 17 at opposite sides of the corresponding lock 13. The notches 17*a* are formed by a mold pin that forms the surfaces of the lock 13 other than the front surface as the mold pin is inserted to the deformation base end 13*a* of the lock 13 while partly cutting the sidewalls 23 and the walls 18. The notches 17*a* have a depth to bulge out more than the inner side surfaces 11*b* of the cavity 11 with respect to widthwise direction WD because the width A of the base 25 is larger than the width C of the cavity 11, as described above. The thickness of the mold pin can be made larger by about the width of the notches 17*a* so that the mold can have a necessary strength. Conversely, the width of the base 25 is made larger by the width of the notches 17*a*, thereby enhancing the strength and locking force of the lock 13. The notches 17*a* are formed in a length range extending from the deformation base end 13*a* of the lock 13 to the front surface of the female housing 10, i.e. in a range of about ¼ of the entire length of the female housing 10 forward and backward along the insertion direction ID.

The mold that is moved backward to open forms rearwardly open notches 29 in the opposite inner side surfaces 11*b* at the sidewalls 23 of the cavities 11. The notches 29 are formed while partly extending the inner side surfaces 11*b* of the cavity 11 outward along widthwise directions WD since the width B of the projection 26 differs only slightly from the width C of the cavity 11. The thickness of the mold pin can be made larger by the width of the notches 29 and the mold can have a necessary strength. Conversely, the width of the projection 26 is made larger by the width of the notches 29. As a result, an area of engagement and a locking force with the female terminal fitting 30 is increased. The depth of the notch 29 along the widthwise direction WD is not as large as a step at the boundary between the front half and the rear half of the inner side surface 11*b* of the cavity 11. Accordingly, the notches 29 are formed in a range extending over the entire length of the front half of the cavity 11, i.e. in a length range of about ⅓ of the entire length of the female housing 10 forward and backward along the insertion direction ID. Further, the forward-opening notches 17*a* extend more outward with respect to widthwise direction WD than the notches 29.

Figure 10:
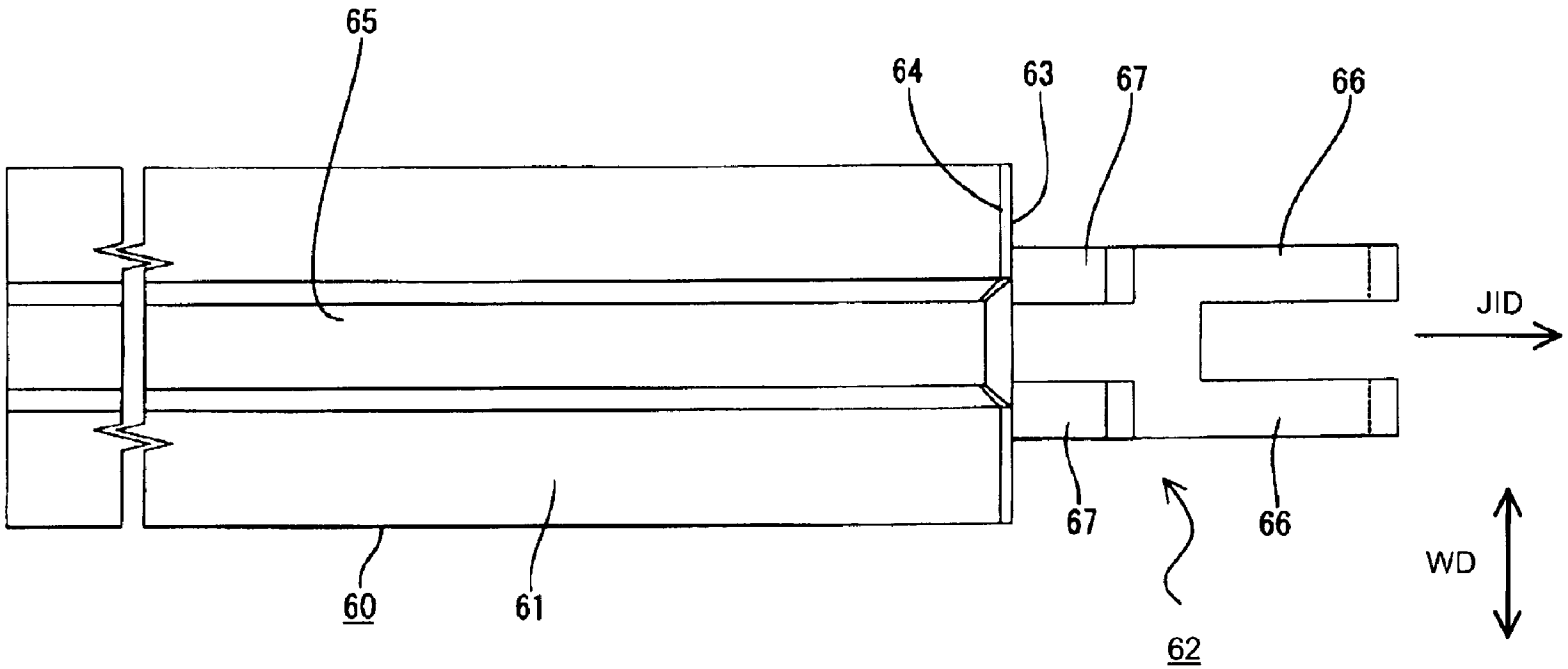
FIG. 10 is a plan view of a disengagement jig.
Figure 11:
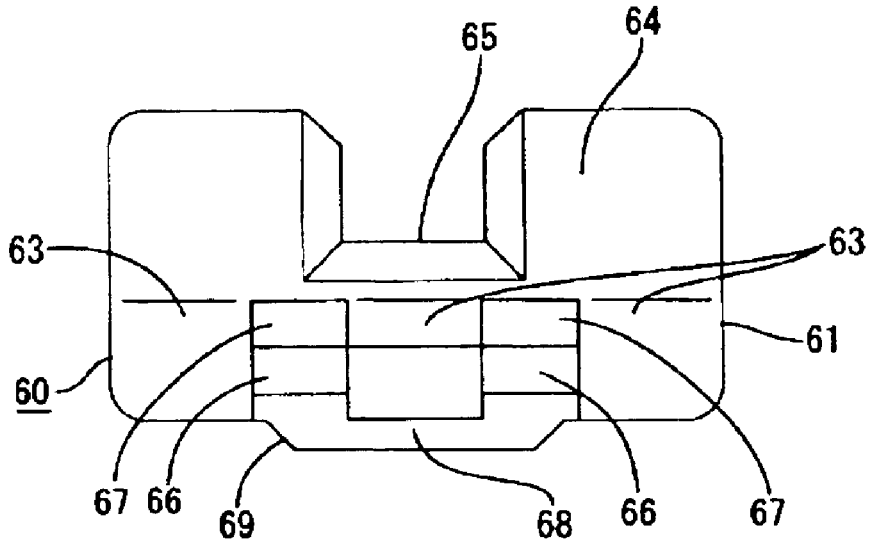
FIG. 11 is a front view of the disengagement jig.
Figure 12:
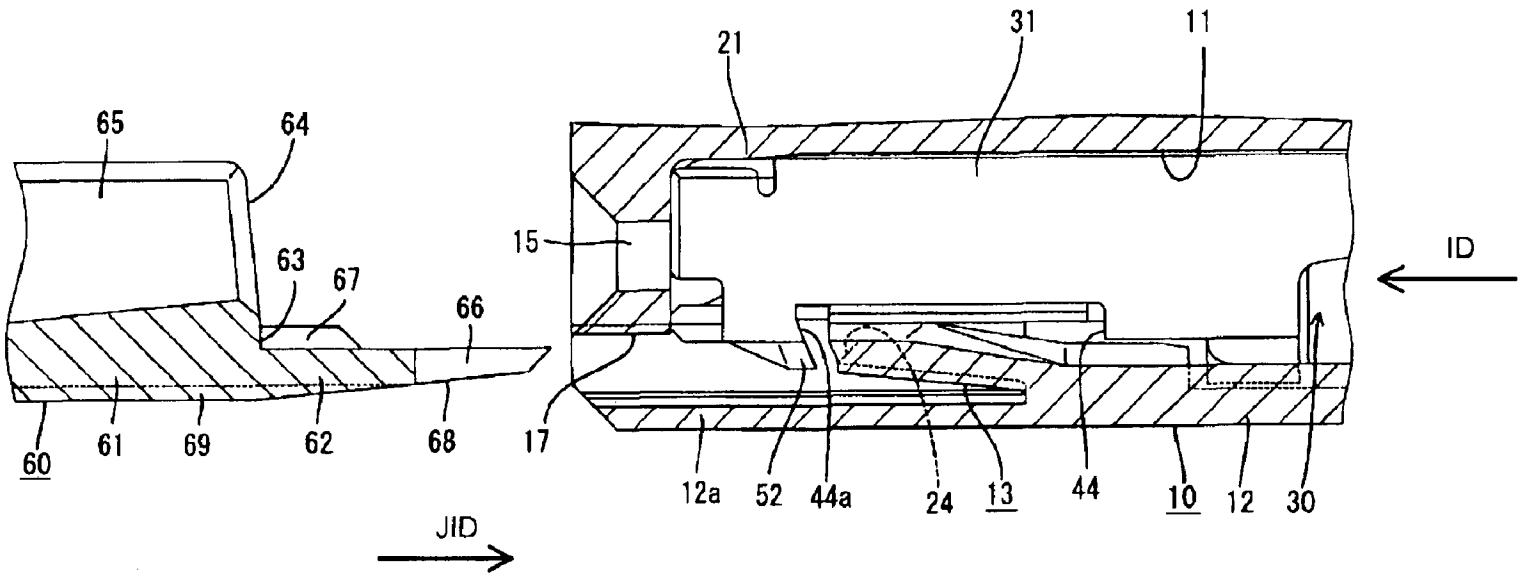
FIG. 12 is a side view in section showing a state where the disengagement jig is inserted into a mold removal hole.

The disengagement jig 60 that is used to detach the female terminal fitting 30 is shown in FIGS. 10 to 12. The disengagement jig 60 has a grip 61 to be held by an operator, a disengaging portion 62 at the leading end of the grip 61 for maneuvering the lock 13, an entrance restricting surface 63 and an inclination restricting surface 64 for restricting a maneuvering range of the disengaging portion 60. The grip 61 is a block that is narrow along forward and backward directions. A receiving recess 65 extends forward and backward substantially in the widthwise middle of the upper surface of the grip 61 for receiving the tab of the male terminal fitting that projects from the front surface of the unillustrated male housing when the disengagement jig 60 is used for the male connector.

The disengaging portion 62 is narrower than the grip 61 and has a forked leading-end that defines maneuvering arms 66. The space between the maneuvering arms 66 is slightly wider than the width of the locking projection 52 of the female terminal fitting 30, and substantially equal to space between the maneuverable recesses 24 of the lock 13. Thus, the leading ends of the maneuvering arms 66 can enter the corresponding maneuverable recesses 24 of the lock 13 while avoiding interference with the locking projection 52 and can press the maneuverable recesses 24 down and out in the deforming direction of the lock 13. The width of the maneuvering arms 66 is substantially equal to the widths of the maneuverable recesses 24. A slanted surface is formed at the leading end surface of each maneuvering arm 66 and has an inclination that substantially conforms with the inclination of the lower surface of the maneuverable recess 24. Two long narrow posture correcting portions 67 project forward on the opposite widthwise sides of the upper surface from a base end of the disengaging portion 62, and the front surfaces of the posture correcting portions 67 are slanted. The posture correcting portions 67 contact the upper edge of the mold removal hole 17 when the disengaging portion 62 is inserted into the mold removal hole 17 of the lock 13. Thus, the inserting posture of the disengagement jig 60 can be corrected into a substantially proper horizontal posture. Further, the posture correcting portions 67 can incline the entire disengagement jig 60 about the portions that contact the upper edge of the mold removal hole 17 due to a leverage action. An escaping slanted surface 68 is formed on substantially the entire lower surface of the disengaging portion 62 including both maneuvering arms 66 and is sloped up toward the leading ends of the maneuvering arms 66. Thus, a specified clearance is formed between the escaping slanted surface 68 and the inner surface of the lowered part 12*a* of the bottom wall 12 (see FIG. 13) when the disengaging portion 62 is inserted into the mold removal hole 17. This clearance permits the leverage action of the disengaging portion 60. Further, a bulge 69 bulges down and out on the lower surface of the disengagement jig 60 from an intermediate position of the escaping slanted surface 68. The bulge 69 has a width for insertion between the jutted portions 12*c*.

An entrance restricting surface 63 is defined at a lower part of the leading end of the grip 61 and extends substantially straight along the vertical direction and substantially normally to both a jig inserting direction JID and the widthwise direction WD. The entrance-restricting surface 63 restricts an inserting depth of the disengaging portion 62 into the mold removal hole 17. An inclination-restricting surface 64 is defined at an upper part of the leading end surface of the grip 61 and slopes back towards the upper end with respect to the inserting direction JID into the mold removal hole 17. The inclination-restricting surface 64 contacts the front surface of the female housing 10 when the disengagement jig 60 undergoes a leverage action, thereby restricting an inclination range of the disengagement jig 60 and restricting a degree of deformation of the lock 13. The degree of resilient deformation of the lock 13 is a minimum and necessary degree to disengage the lock 13 from the female terminal fitting 30, and is set within the resiliency limit of the lock 13.

The wire W initially is connected with the barrel 32 of the female terminal fitting 30, and the female terminal fitting 30 then is inserted into the cavity 11 from behind and in the inserting direction ID, as shown in FIG. 7. An attempt could be made to insert the female terminal fitting 30 in an improper posture e.g. upside down. However, the front end surface of the stabilizer 47 contacts the restricting portion 22 at the rear peripheral edge of the cavity 11 to prevent the insertion. In this way, the improper, e.g. upside-down, insertion of the female terminal fitting 30 is prevented.

The female terminal fitting 30 then is inserted into the cavity 11 in its proper inserting posture. Thus the locking projection 52 and then the protrusion 49 are inserted into the protrusion insertion groove 19 and the stabilizer 47 is inserted into the stabilizer insertion groove 20. As a result, the female terminal fitting 30 is inserted smoothly while being prevented from shaking vertically and transversely. The lock 13 is pressed by the locking projection 52 and is deformed resiliently out and down when the female terminal fitting 30 is inserted to a specified depth. The locking projection 52 has a pyramidal shape with a vertex at its front end. Thus, the locking projection 52 is inserted smoothly into the protrusion insertion groove 19 and smoothly presses the lock 13.

Figure 8:
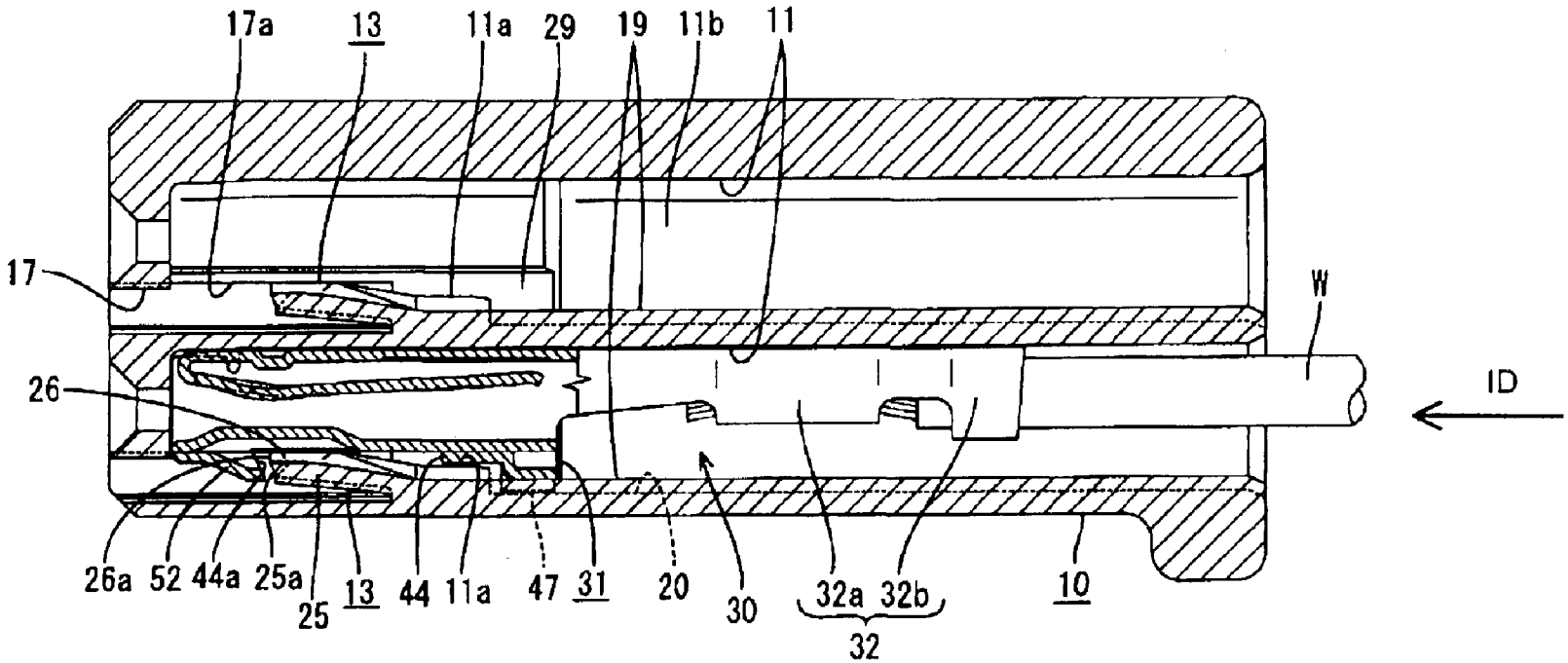
FIG. 8 is a side view in section showing a state where the female terminal fitting is inserted in the female housing.
Figure 9:
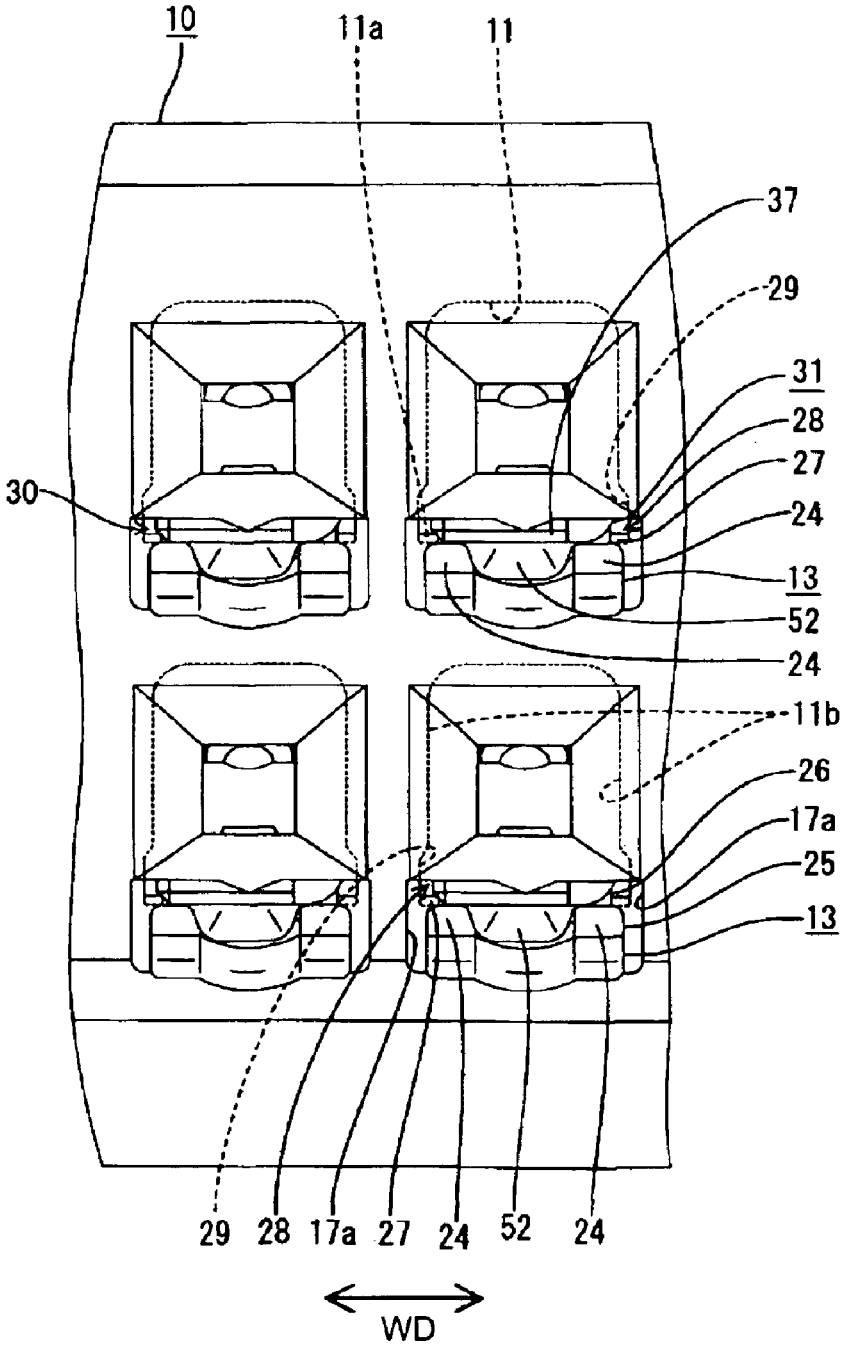
FIG. 9 is a front view showing a state where the female terminal fittings are inserted in the female housing.

As the female terminal fitting 30 is inserted to the proper depth in the cavity 11, the locking projection 52 moves over the lock 13 and the lock 13 is restored resiliently. Thus, the locking projection 52 is engaged with the female terminal fitting 30 by entering the cut-away portion 44, as shown in FIG. 8. At this time, the projection locking surface 25*a* of the lock 13 engages the rear end surface of the locking projection 52, and the main-portion locking surface 26*a* of the lock 13 engage the portions of the front cut end surface 44*a* of the cut-away portion 44 at the opposite sides of the locking projection 52. Accordingly, the lock 13 engages substantially the entire width of the female terminal fitting 30, thereby displaying a strong locking force. Further, the front cut end surface 44*a* of the cut-away portion 44 including the locking projection 52 is overhanging or undercut. Thus, the locking force is stronger. The depth of engagement of the lock 13 with the female terminal fitting 30 is large because the front end of the main portion 31 is displaced by being pressed down or inwardly by the bulge 21 on the upper surface of the cavity 11 to approach the lock 13. Further, as shown in FIG. 9, the locking projection 52 is displaced from both maneuverable recesses 24 of the lock 13 along the widthwise direction WD and is exposed to the outside at front together with the maneuverable recesses 24.

Figure 13:
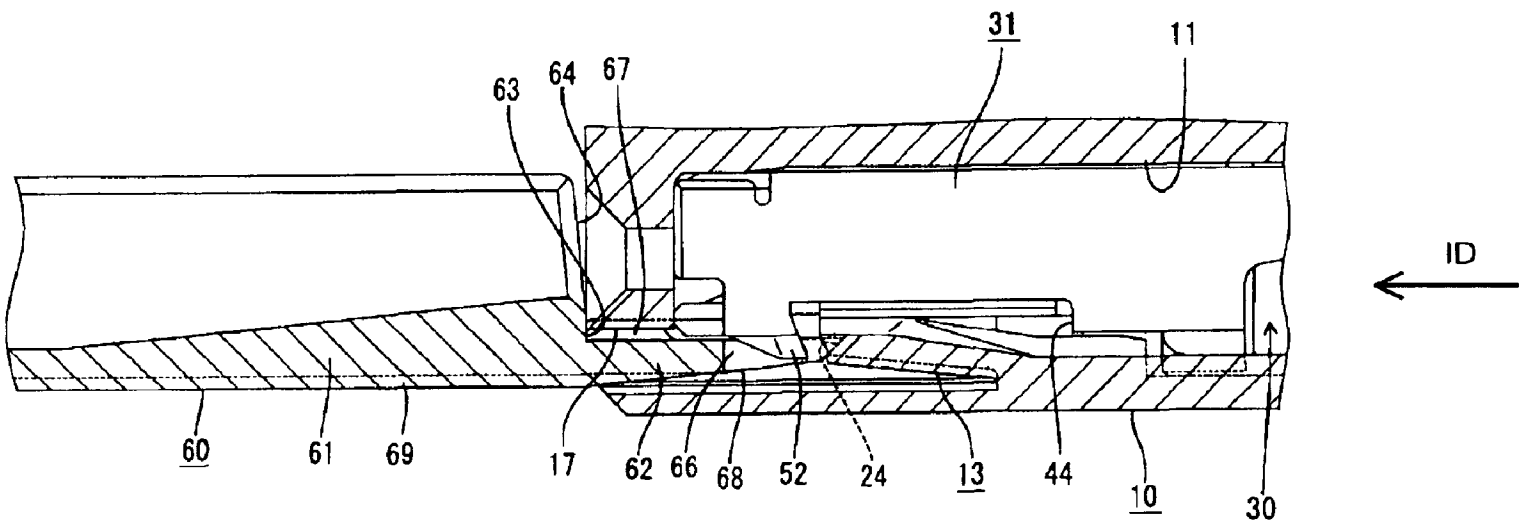
FIG. 13 is a side view in section showing a state where maneuvering arms are inserted into maneuverable recesses.

The female terminal fitting 30 may be withdrawn from the female housing 10 for maintenance or other reason. In such a case, as shown in FIG. 12, the leading ends of the maneuvering arms 66 are pushed into the mold removal hole 17 while holding the grip 61 of the disengagement jig 60. In this pushing process, the entire disengagement jig 60 can be held in a substantially horizontal posture by bringing the two posture correcting portions 67 into sliding contact with the upper edge of the mold removal hole 17. Further insertion of the disengagement jig 60 in the jig insertion direction JID is prevented when the entrance restricting surface 63 contacts the front surface of the female housing 10, as shown in FIG. 13. At this time, the leading ends of the maneuvering arms 66 enter the two maneuverable recesses 24 and the slanted surfaces of both sides align and contact. Clearances are defined between the escaping slanted surface 68 and the lowered part 12*a* of the bottom wall 12 and between the inclination-restricting surface 64 and the front end surface of the female housing 10.

Figure 14:
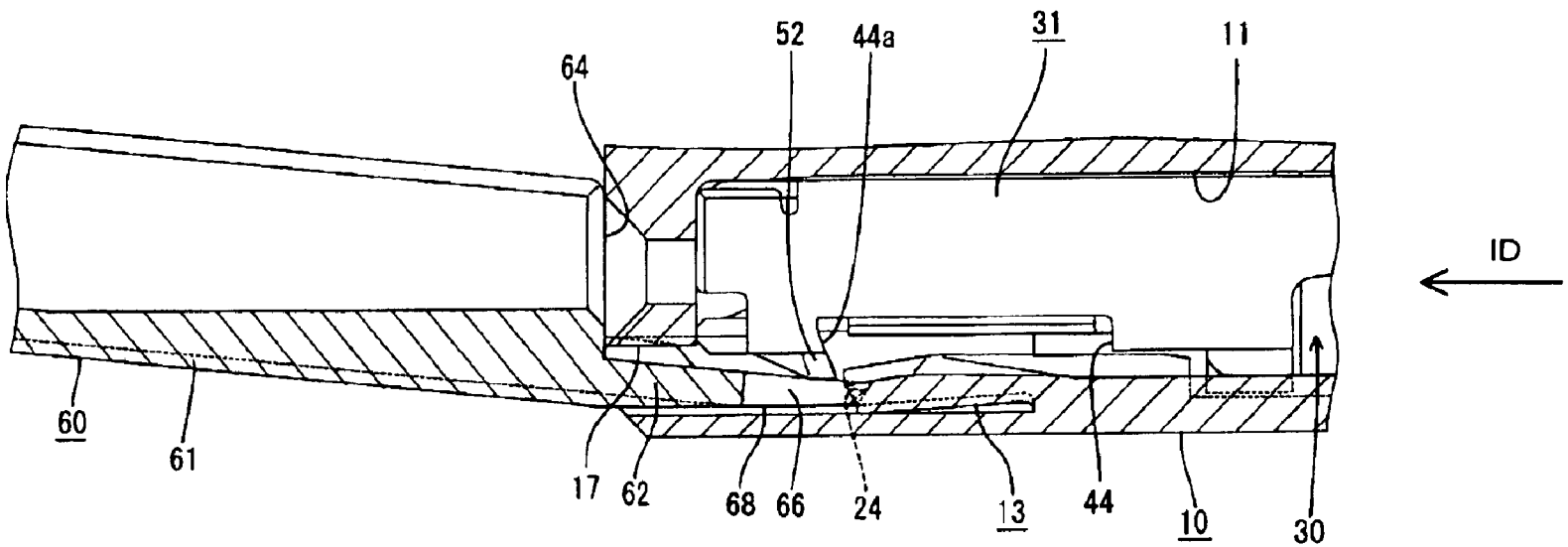
FIG. 14 is a side view in section showing a state where a locking portion is resiliently deformed by a leverage action.
Figure 15:
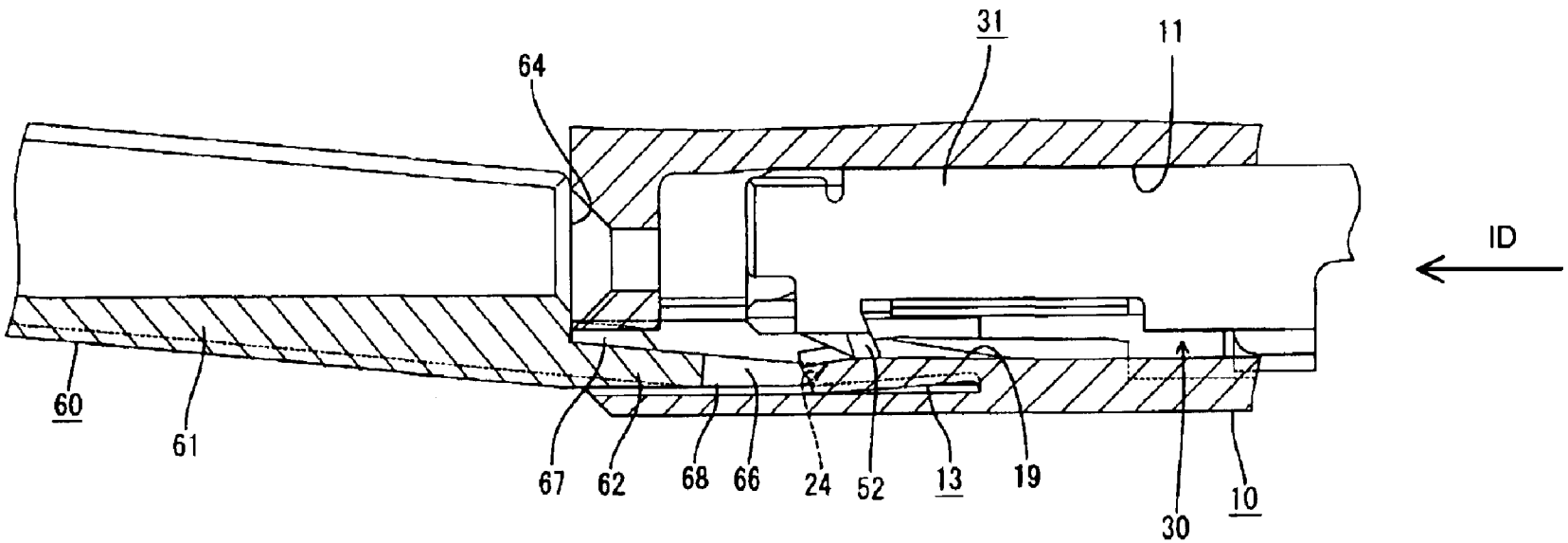
FIG. 15 is a side view in section showing an intermediate stage of the withdrawal of the female terminal fitting.

In this state, the disengagement jig 60 can be lever-operated by lifting the grip 61 with the contact portions of the base ends of the posture correcting portions 67 and the upper edge of the mold removal hole 17 as supporting points. Thus, the jig 60 is inclined until the inclination restricting surface 64 contacts the front end surface of the female housing 10, as shown in FIG. 14. At this time, the escaping slanted surface 68 contacts or is in proximity to the lowered part 12*a* of the bottom wall 12. Then, the maneuvering arms 66 press the maneuverable recesses 24 down to resiliently deform the lock 13 out and down. In this way, the lock 13 undergoes a minimum resilient deformation necessary to be disengaged from the female terminal fitting 30. Therefore, the female terminal fitting 30 can be pulled back from the state shown in FIG. 15 and withdrawn.

As described above, the notches 17*a* open in the front surface of the female housing 10 by the mold that is moved forward to open to form the substantially opposite widthwise side surfaces 25*b* of the bases 25 including the deformation base ends 13*a*. Thus, the thickness of the mold, i.e. the width of the bases 25 is larger by the width of the notches 17*a*, with the result that the strength of the bases 25 and the locking forces for locking the female terminal fittings 30 is increased. Since the notches 17*a* are formed in an area of the female housing 10 before the deformation base ends 13*a* of the locks 13, i.e. in a relatively small length area (preferably less than about half, most preferably about ¼ of the entire length) as compared to the entire female housing 10, a reduction in the strength of the female housing 10 caused by the notches 17*a* can be maximally suppressed.

If the projecting portion 26 should be formed to have the substantially same width as the base 25, the notches 29 formed in the inner side surfaces 11*b* of the cavity 11 by the mold moved backward to open are deeper in widthwise outward directions. Since the notches 29 are larger (preferably about ⅓ of the entire length of the female housing 10) in the length area than the forward-opening notches 17*a*, the strength of the female housing 10 may be reduced. Accordingly, in this embodiment, the projection 26 is formed to be narrower than the base 25. Thus, the width of the backward-opening notches 29 can be made smaller than that of the forward-opening notches 17*a*, with the result that the strength of the female housing 10 can be kept high. In other words, the width B of the projection 26 is set to ensure a largest area of engagement with the female terminal fitting 30 and to properly maintain the strength of the female housing 10, whereas the base 25 is formed to be wider than the projection 26 to further enhance the strength of the lock 13.

Further, since the maneuverable recesses 24 are formed to extend more outward with respect to widthwise direction WD than the projection 26, the maneuvering arms 66 of the disengagement jig 60 can be formed wider. This enhances the strength of the disengagement jig 60 and increases the areas of the maneuvering arms 66 of the disengagement jig 60 pressing the maneuverable recesses 24. As a result, the disengagement operability of the locking portion 13 can be improved.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

Although the backward-opening notches are formed in the foregoing embodiment, such notches may not need be formed depending on the width of the projections.

The side surfaces of the projections are formed partly by the mold that is moved forward to open since the reinforcing portions for reinforcing the locks are provided in the foregoing embodiment. However, the entire side surfaces of the projections can be formed by the mold that is moved back to open if no reinforcing portion is formed.

Although the width of the base portions is larger than that of the cavities in the foregoing embodiment, it may be substantially equal to or smaller than the width of the cavities according to the present invention.

Maneuverable recesses for the disengagement jig are in the front surfaces of the bases in the foregoing embodiment. However, maneuverable portions may project forward from the front surfaces of the bases or may project sideways from the side surfaces of the projections. The number of the maneuverable recesses also can be set at a number other than two.

The female housing is molded by front and rear molds in the foregoing embodiment. However, the housing may be molded by slidable molds that open and close along vertical and/or widthwise directions WD in addition to the front and rear molds. Such molds are used if the outer surface of the female housing needs to be open in a vertical and/or widthwise direction WD, such as a case where a side retainer is to be mounted.

A female connector is shown in the foregoing embodiment. However, the invention also is applicable to male connectors. Further, although each lock is supported at one end thereof in the foregoing embodiment, the invention is also applicable to locks supported at both ends for resilient deformation.

What is claimed is:

1. A connector with a housing having opposite front and rear ends and at least one cavity extending between the ends for receiving a terminal fitting inserted from the rear end and along an inserting direction, a notch extending into the front end of the housing and partway towards the rear end, the notch communicating with the cavity, and a resiliently deformable lock cantilevered forwardly from a wall of the housing for engaging the terminal filling, wherein:

the lock comprises a base disposed in the notch and a projection projecting from the base into the cavity, the base having opposite widthwise side surfaces defining a width with respect to a widthwise direction extending normal to a deformation direction of the lock, and the projection having opposite widthwise side surfaces defining a width narrower than the width of the base.

2. The connector of claim 1, wherein a maneuverable portion is provided at the front surface of the base for engagement by a jig to resiliently deform the lock in an unlocking direction.

3. The connector of claim 2, wherein the maneuverable portion is formed in a width range to cover a part of the base bulging out more than the projection with respect to the widthwise direction.

4. The connector of claim 1, further comprising at least one reinforcement between the projection and the base.

5. A method for molding a connector housing with opposite front and rear ends and at least one cavity into which a terminal fitting is insertable in an inserting direction, a resiliently deformable lock provided in the cavity for engaging the terminal fitting, the lock comprising a base including a deformation base end, and a projection projecting into the cavity from the base, the method comprising:

molding opposite widthwise side surfaces of the projection by a cavity mold moved forward to open, molding the cavity and opposite widthwise side surfaces of the base, forming and a notch with a base mold moved forward to open so that the notch opens in the front end of the connector housing and extends more outward than the inner side surfaces of the cavity with respect to a widthwise direction, and wherein the projection is formed to have a width narrower than the width of the base.

6. The method of claim 5, wherein the lock is molded to have a maneuverable portion at the front surface of the base, the maneuverable portion being maneuverable by a jig to resiliently deform the lock in an unlocking direction.

7. The method of claim 6, wherein the maneuverable portion is formed in a width range to cover a part of the base bulging more outward than the projection with respect to the widthwise direction.

8. The method of claim 5, wherein reinforcing portions are molded between the projection and the base.

9. A connector with a housing having opposite front and rear ends and at least one cavity extending between the ends for receiving a terminal fitting along an inserting direction, a notch extending into the front end of the housing and continuing partway towards the rear end, portions of the notch communicating with the cavity, a resilient deformable lock cantilevered forwardly from a wall of the housing, the lock comprising a base disposed in the notch and a projection projecting from the base into the cavity, the resiliently deformable lock being deformable in a deformation direction so that the projection deflects from the cavity towards the notch, the cavity and the notch each defining widths measured normal to the inserting direction and normal to the deformation direction, the width of the notch exceeding the width of the cavity.

10. The connector of claim 9, wherein the base and the projection of the lock have widths extending normal to the inserting direction and normal to the deformation direction, the width of the base exceeding the width of the projection.

* * * * *